United States Patent [19]

Briggs et al.

[11] Patent Number: 4,901,897

[45] Date of Patent: Feb. 20, 1990

[54] CONVERTIBLE GARMENT BAG WITH ALTERNATE CARRYING MEANS

[76] Inventors: Marcia Briggs, P.O. Box 3696, Chico, Calif. 95927; Roulette W. Smith, P.O. Box 4061, Stanford, Calif. 94305

[21] Appl. No.: 779,627

[22] Filed: Sep. 24, 1985

[51] Int. Cl.[4] ..... B65D 85/18; A45C 9/00

[52] U.S. Cl. ..... 224/153; 224/151; 224/209; 206/287.1

[58] Field of Search ..... 224/153, 151, 209; 206/287, 287.1

[56] References Cited

U.S. PATENT DOCUMENTS

| | | | |
|---|---|---|---|
| 2,261,291 | 11/1941 | Salavsky | 206/287.1 |
| 3,958,675 | 5/1976 | Rosenblum | 206/287.1 |
| 4,346,657 | 12/1980 | Brunton | 224/153 |

*Primary Examiner*—Henry J. Recla
*Attorney, Agent, or Firm*—Bielen & Peterson

[57] ABSTRACT

A convertible garment bag is fabricated with alternate carrying means to permit the bag to be transported by the luggage handle, a shoulder strap or a backpack harness, thereby enabling a traveler to include in a single bag both formal wear and casual wear for all occasions, and, allowing the traveler the option of carrying the bag as conventional travel luggage or as a mountaineering pack. The garment bag is constructed in the form of an elongated casing with a hook at one end to hand the casing and contained garments for temporary storage with minimal wrinkling of the contained garments. The casing has a perimeter closure device to enable the casing to fold into multiple segments that interfasten to form a unitary compact pack for convenient transport by one of the alternate carrying means.

16 Claims, 2 Drawing Sheets

CONVERTIBLE GARMENT BAG WITH ALTERNATE CARRYING MEANS

BACKGROUND OF THE INVENTION

This invention relates to travel luggage and more particularly to a garment bag that includes a novel perimeter closure on folding to form a unitary pack or satchel, in combination with alternate carrying means to convert the garment bag from travel luggage to a backpack.

Seasoned travelers, having experienced the vagaries of transportation systems and transitory accommodations, readily prefer a style of luggage that is classified as "carry-on" by the airlines. Such luggage must either fit under the airline seat or be of a size and softness to fit in an overhead storage cabinet. Compliance with this informal standard will enable the passenger to avoid baggage check-in and time consuming, baggage claim with the attendant potential of loss or incorrect routing of luggage. Compact carry on luggage has the benefit to the airline for anti-terrorist measures as all such luggage is x-rayed and associated with a passenger.

Because such luggage must predominantly be carried with the traveler, the luggage must be efficiently organized with various means for convenient portage maximizing free use of the hands during boarding procedures.

In conformity with this independent style of air travel, the dynamic traveler will desire a style of luggage that can be tirelessly carried substantial distances during walking tours, or bus, train and ferry transports prior to check-in or after check-out at hotels or other lodging. The sophisticated pleasure traveler and business traveler will want all such convenience features plus the ability to pack formal wear or business attire without the need for pressing before wearing.

While prior art luggage designs include features to satisfy one or more of the above described criteria, no previous design fulfills all desired requirements. Of greatest difficulty is the adaptation of a garment bag to an all purpose travel bag. Simply adding a shoulder strap or a back pack harness to a conventional garment bag will be inadequate to preserve the integrity of the garments contained therein. Particular precautions and design features must be combined to produce a hangable garment bag that can be compacted to a unitary soft pack of sufficient structural substance to adapt the pack for portage by a handle, a shoulder strap and in particular backpack harness.

SUMMARY OF THE INVENTION

The garment bag of this invention comprises a convertible garment casing that folds into a compact pack or satchel that is equipped with convenient alternate carrying means. In particular, the garment bag includes casing closure means and clothes securing means enabling the compact satchel to be equipped with an integral backpack harness for conversion of the garment bag into a backpack. It is inherent that orientation of the clothes contained in a garment bag when carried on the back will cause shifting and dishevelling of the clothes. The integral securing means for restraining hung garments and the perimeter closure means for converting a folded casing to a unitary parcel are important cooperating features for the unlikely conversion of the garment bag to a backpack.

The preferred embodiment of the convertible garment bag includes a casing with a hanger device enabling the casing to be hung from a conventional garment rod or hook with the contained clothes suspended on common hangers. The casing includes securing means such as clips or straps to secure the clothes flat against the wall of the casing to prevent shifting of the clothes when the casing is folded into a satchel. The securing means is particularly important in the preferred embodiment as the satchel is oriented on end in the back portage mode. The casing when folded arranges a perimeter zipper in operative juxtaposition for fastening the two folds of the casing together by joining the perimeter open edges forming a unitary pack. The pack in the form of a traveling satchel includes both a handle and a strap for carrying. In addition, the satchel includes a concealed backpack harness which when extracted enables the satchel to be oriented on end and carried in the manner of a backpack.

These and other features will become apparent on considering the detailed consideration of the preferred embodiments described hereafter.

DETAILED DESCRIPTION OF THE PREFERRED EMBODIMENTS

Figure 1:
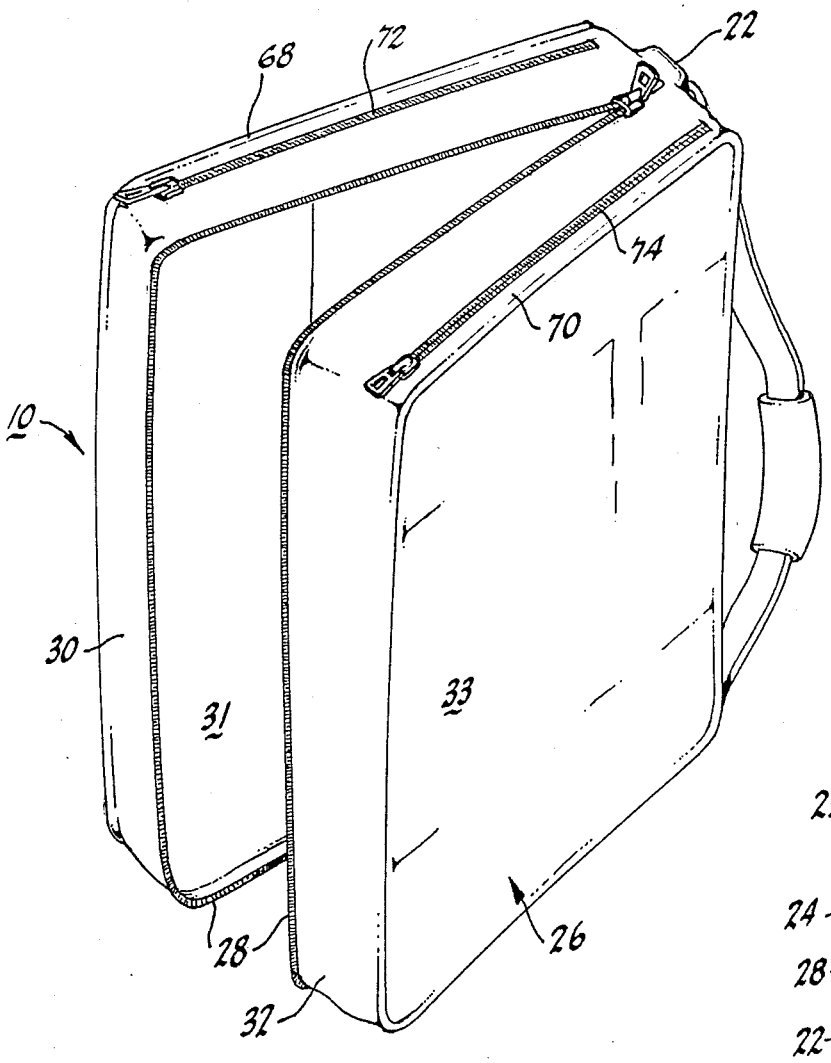
FIG. 1 is a perspective view of the convertible garment bag partially opened.
Figure 2:
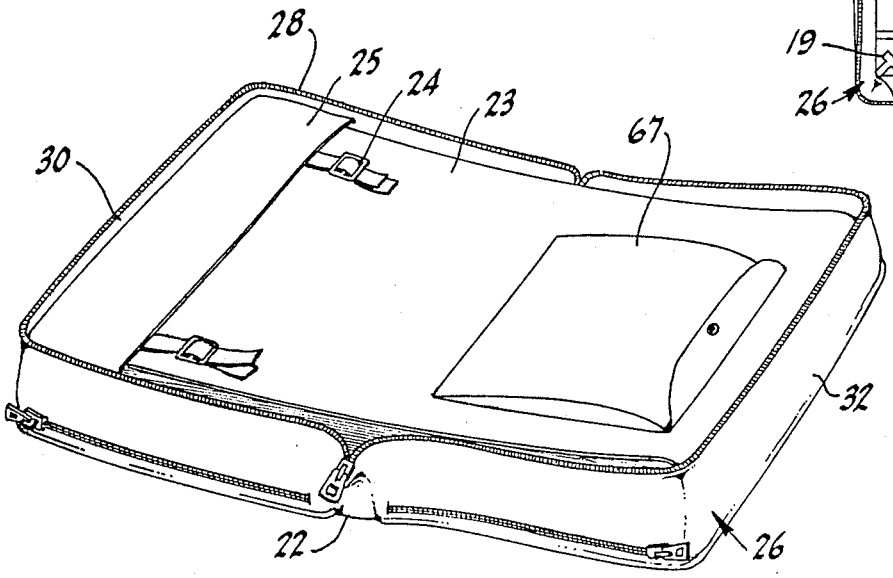
FIG. 2 is a perspective view of the garment bag in open position.

Referring to FIGS. 1 & 2, the convertible garment bag of the invention designated generally by the reference numeral 10 is shown in an open position.

Figure 3:
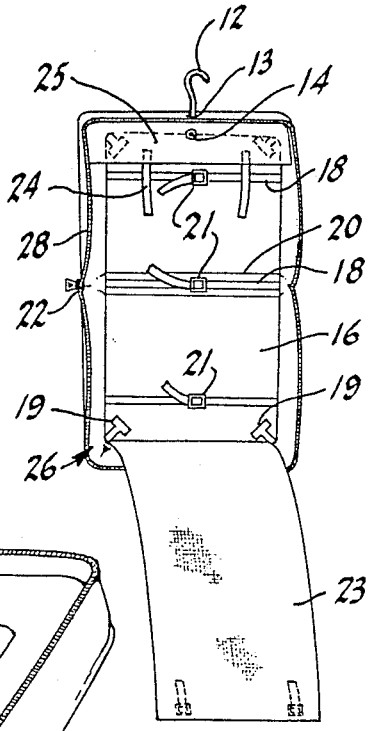
FIG. 3 is a perspective view of the garment bag with opened cover flap withdrawn exposing retention straps.

As shown in FIG. 3, the garment bag 10 has a hook 12 which is adapted to engage a conventional garment rod or a clothes hook and suspend the garment bag in a conventional manner. The hook 12 is concealable within the bag by being drawn through a slot 13 when not in use. Clothes are hung on conventional hangers (not shown) which hang on a small internal loop 14 mounted proximate the anchored end of the hook 12. Alternately, the hook 12 can be by passed and the hooked ends of the clothes hangers projected through the slot 13 for direct engagement with the external rod or hook. This feature is useful where long garments are packed, but is inconvenient when the garment bag is converted to a pack.

The hung garments lie flat against an internal panel 15, and are secured thereto by straps 18 across the garments which prevent the garments from shifting and becoming dishevelled when the bag is converted to a carrying satchel. Behind the center strap 18 is a concealed fixed batten 20 which provides a stiffening backbone for the folding edge 22 of the garment bag. The straps are anchored at the inside perimeter edge of the bag and include an adjustment buckle 21 for tightening the straps. Optionally the straps 18 can include floating battens to assist in securing the hung garments flat against the internal panel 16.

Figure 4:
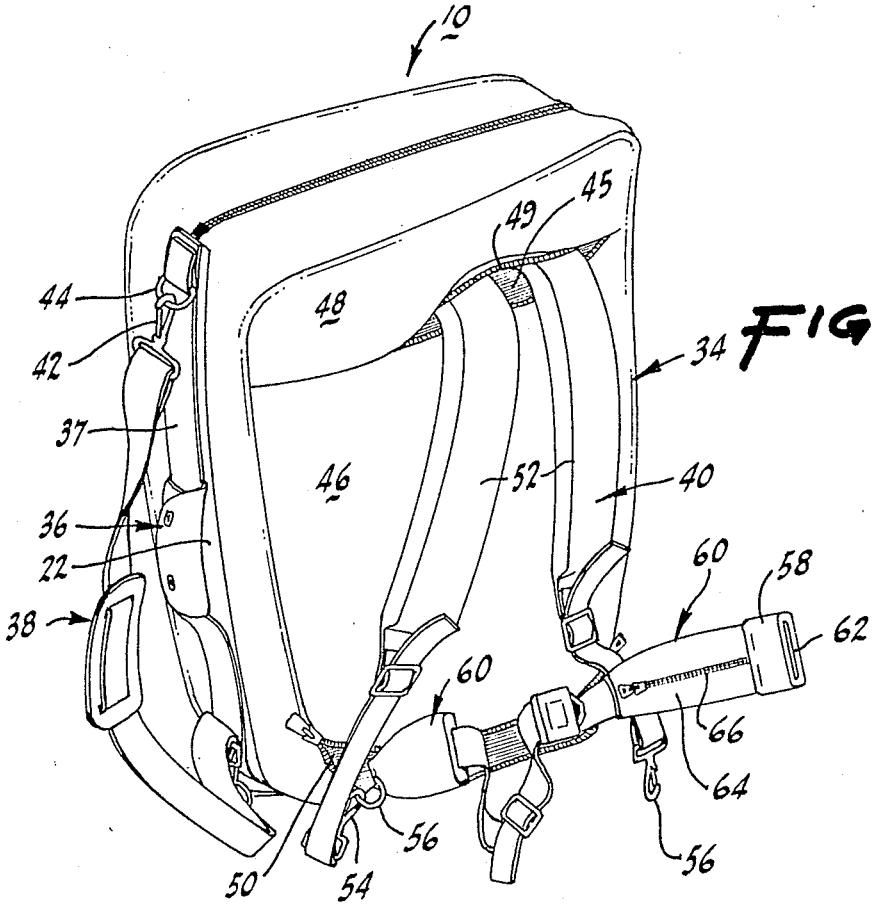
FIG. 4 is a perspective view of the garment bag closed with a backpack harness exposed.

Other means such as tethered corner clips 19 which grasp the edges of at least the outer garments are optionally or complimentarily included to secure the garments in place during portage of the bag. In this respect, the covering flap 23 has a high friction surface off course weave or rough matt to inhibit shift of the garments. The cover flap 23 is joined to the inside bottom edge of the bag and connected by a strap and buckle unit 24 to a top leaf 25 at the top of the bag and compartmentalizes the suspended garments prior to folding of the bag to form a pack. Inhibiting shift of the garments is of particular importance since the soft pack is designed to transport formal or dress wear. Dishevelling of the clothes is particularly acute in the preferred on-end orientation of the pack on conversion of the garment bag to a backpack as shown in FIG. 4. The combination of the clothes securing means and the casing closure means to join the folded halves of the garment bag into a unitary pack maintains the clothes in position, thereby minimizing wrinkling.

The garment bag 10 is fabricated with an elongated casing 26 that can be folded in segments with a folded edge 22 and juxtaposed open edges 30 and 32 secured as illustrated by a perimeter zipper 28 that secures the open perimeter edge 30 of one segment 31 to the open perimeter edge 32 of the other segment 33 forming a compact, unitary pack or satchel 34. The formed satchel 34 as shown in FIG. 4, is equipped with three alternate carrying means, a handle 36, a shoulder strap 38 and a backpack harness 40. The handle 36 is snapped around a nylon reinforcement web 37, which except for a center handle segment is fastened to the folded backbone edge 22. The handle 36 provides a convenient means for carrying the satchel in the manner of a suitcase. The shoulder strap 38 has two end clips 42 which engage anchored rings 44 on the ends of the backbone edge 22 of the satchel enabling the strap 38 to be removed. The backpack harness 40 is normally concealed within a pouch 45 formed by an outer panel 46 having a top flap 48 with a zipper closure 49. A pair of padded shoulder straps 52 anchored at the top and having a pair of end clips 54 can be extracted from under the flat 48 and clipped to tethered corner rings 56 that are withdrawn from the corner slots 50. Similarly, the two ends 58 of a padded waist strap 60 with a snap buckle 62 can be extracted from the corner slots 50 and coupled around a user's back with the folded edge vertically oriented. The shoulder straps and waist strap are adjustable in length to accommodate any user. The waist and/or shoulder straps include inside pouch 64 with zipper closure 66 for money or documents in the fashion of a money belt allowing convenient access without removal of the pack.

When the straps are tucked into the pouch and the corner slots are secured the pack comprises a satchel with the pouch available for additional items. Conversely when the shoulder strap 38 and, if desired, the satchel handle 36 are stored and the backpack harness 40 is extracted, the pack comprises a backpack. Care, however, must be taken in this mode for items in the pouch 45 which could escape through open slots.

Additional articles of clothing or personal effects can be stored in the main compartment of the garment bag, and desirably so to prevent shifting of the clothes hung on the harness. Additionally, a valise, soft attache' case or art folder 67 can be stored between the folded flaps 30 and 32 of the garment bag to free the user's hands, particularly when the bag is converted to a backpack.

Figure 5A:
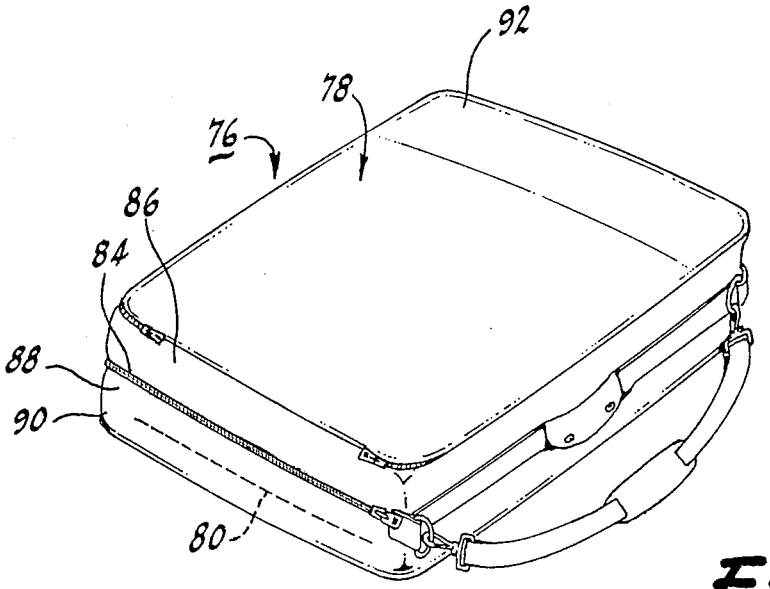
FIG. 5A is a perspective view of an alternate embodiment of the garment bag closed with a shoulder strap and handle exposed.
Figure 5B:
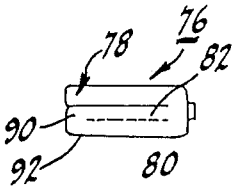
FIG. 5B is a schematic of the alternate embodiment illustrating the manner of folding the case.

The garment bag is equipped with two auxiliary side pouches 68 and 70 with zippered closures 72 and 74. With a full compliment of storage pouches, a garment bag of the described design can effectively store more than 4000 cubic inches of items.

Where it is desired that the garment bag casing be elongated to accommodate dresses and the like, a modified embodiment of the casing is constructed as shown in FIGS. 5A and 5B. While the garment bag 76 of the modified embodiment has the same outer appearance as the previously described embodiment, and utilizes the same alternative carrying means, the casing 78 is folded in three segments as shown in FIG. 5B. Two concealed side zippers 80 (one shown in dotted line) secure a bottom fold 82 as a preliminary internal tuck. A perimeter outer zipper 84 secures the top fold 86 to an extending cuff 88 of the double segment bottom fold 90 wherein the open perimeter edges are secured to form a unitary pack in the same manner as the primary embodiment with the addition of the internal tuck. In this manner an extended casing to accommodate dresses or overcoats can be folded to a unitary pack which can still be carried on the user's back with the backpack harness. Again because the folded height of the formed satchel is smaller than the width, it is preferred that the harness be arranged such that the satchel is on end with the folded edge vertically oriented during back portage. This modified embodiment includes a thin foam cover lining (not visible) inside the outer covering 92 such that the garment bag can be used as a portable futon style mattress. Other support padding or bladder can be included to accomplish this use.

While in the foregoing embodiments of the present invention have been set forth in considerable detail for the purposes of making a complete disclosure of the invention, it may be apparent to those of skill in the art than numerous changes may be made in such detail without departing from the spirit and principles of the invention.

What is claimed is:

1. A convertible garment bag comprising:

a. an elongated garment casing with a backside and a frontside with opening and closure means on the front side for inserting clothes in the garment casing, said casing having means for suspending garments on conventional hangers within the casing;

b. a perimeter closure means for converting said elongated garment casing into a compact unitary pack, wherein the garment casing is folded into at least two segments with three juxtaposed open perimeter edges and a folded edge, said closure means comprising a perimeter zipper for securing said open edges together continuously along the three perimeter edges wherein a unitary closed pack is formed;

c. a back pack harness connected to the backside of the casing on one of said folded segments of said unitary pack, said harness being arranged for carrying said pack when said garment bag is converted into a pack.

2. The garment bag of claim 1 wherein said suspending means comprises a loop member fixed to said casing adapted to engage conventional garment hangers and an extractable hook member anchored to said bag adapted to engage a conventional garment rod or clothes hook.

3. The garment bag of claim 1 wherein said garment casing include internal means for securing garments suspended on hangers in said bag flat against said casing.

4. The garment bag of claim 3 wherein said internal means for securing garments suspended on hangers comprises at least one inside strap across contained garments in the bag.

5. The garment bag of claim 3 wherein said garment bag on folding has a folded edge with an internal stiffening member, said garment securing means comprising an inside strap across contained garments in the bag, said strap arranged in juxtaposition to said internal stiffening member.

6. The garment bag of claim 5 wherein said securing means includes two additional straps across contained garments in the bag, said additional straps being arranged above and below said strap juxtaposed to said stiffening member.

7. The garment bag of claim 6 wherein said garment casing has an outer panel forming a pouch between said panel and said casing, said backpack harness being attached to said and storable in said pouch when not in use.

8. The garment bag of claim 3 wherein said internal means for securing garments suspended or hangers comprises clothing clamps engaging at least a portion of garments contained in said bag.

9. The garment bag of claim 3 wherein said internal means for securing garments suspended or hangers comprises a cover flap having a high friction surface, said cover flap covering contained garments prior to folding of the bag to form a pack.

10. The garment bag of claim 1 wherein said garment casing on being formed into a unitary pack, includes alternate carrying means.

11. The garment bag of claim 10 wherein said alternate carrying means includes a handle connected to said pack at the center of the folded edge of said casing.

12. The garment bag of claim 11 wherein said alternate carrying means includes a shoulder strap connected to said pack at the ends of the folded edge of said casing.

13. The garment bag of claim 1 wherein said backpack harness comprises a pair of shoulder straps and a waist strap.

14. The garment bag of claim 13 wherein said backpack harness includes a document pouch in at least one of the straps.

15. The garment bag of claim 1 wherein said backpack harness is arranged on said garment casing wherein the folded edge is vertically oriented at one side of the user's back during portage.

16. The garment bag of claim 15 wherein said elongated casing includes an elongated padding means for converting an open casing to a sleeping pad.

* * * * *